US008459841B2

(12) United States Patent
Huang et al.

(10) Patent No.: US 8,459,841 B2
(45) Date of Patent: Jun. 11, 2013

(54) LAMP ASSEMBLY

(75) Inventors: Tien-Fu Huang, Hsinchu County (TW); Chen-Dao Shiao, Hsinchu (TW); Chi-Hua Yu, Hsinchu (TW); Kuo-An Wu, Changhua County (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 12/834,823

(22) Filed: Jul. 12, 2010

(65) Prior Publication Data

US 2011/0253358 A1 Oct. 20, 2011

(30) Foreign Application Priority Data

Apr. 19, 2010 (TW) ..... 99112126 A

(51) Int. Cl.
*F21V 29/00* (2006.01)

(52) U.S. Cl.
USPC ..... 362/294; 362/311.02; 362/373; 362/345; 362/800

(58) Field of Classification Search
USPC ..... 362/294, 311.02, 373, 546, 547, 362/218, 264, 345, 800, 166, 172, 181, 230, 362/231, 234, 249.01, 249.02, 310
See application file for complete search history.

(56) References Cited

U.S. PATENT DOCUMENTS

| | | | |
|---|---|---|---|
| 6,511,209 | B1 | 1/2003 | Chiang |
| 6,787,999 | B2 | 9/2004 | Stimac et al. |
| 6,864,513 | B2 | 3/2005 | Lin et al. |
| 7,144,140 | B2 | 12/2006 | Sun et al. |
| 7,458,706 | B1 | 12/2008 | Liu et al. |
| 7,513,653 | B1 | 4/2009 | Liu et al. |
| 7,549,772 | B2 | 6/2009 | Wang |
| 7,549,774 | B2 | 6/2009 | Tsai |
| 7,568,817 | B2 | 8/2009 | Lee et al. |
| 7,575,346 | B1 | 8/2009 | Horng et al. |
| 7,581,856 | B2 | 9/2009 | Kang et al. |
| 7,623,348 | B2 | 11/2009 | Otsuki et al. |
| 7,637,635 | B2 | 12/2009 | Xiao et al. |
| 7,637,636 | B2 | 12/2009 | Zheng et al. |
| 7,670,028 | B2 | 3/2010 | Liu et al. |
| 7,824,077 | B2 | 11/2010 | Chen et al. |

(Continued)

FOREIGN PATENT DOCUMENTS

| | | |
|---|---|---|
| CN | 201096292 | 8/2008 |
| CN | 201133635 | 10/2008 |

(Continued)

OTHER PUBLICATIONS

Taiwan Patent Office, Office Action, Patent Application Serial No. 099112125, Jun. 15, 2012, Taiwan.

(Continued)

*Primary Examiner* — Evan Dzierzynski
*Assistant Examiner* — Danielle Allen

(57) ABSTRACT

A lamp assembly is provided, including a light source, a thermal module, a connecting member, and an adapter electrically connected to the light source. The thermal module includes a first thermal member and a second thermal member. The first and second thermal members respectively have a plurality of first and second fins which are arranged in a staggered manner. The second thermal member forms a plurality of through holes for heat dissipation. The light source is disposed on the second thermal member, and the connecting member connects the thermal module with the adapter.

13 Claims, 6 Drawing Sheets

U.S. PATENT DOCUMENTS

| | | | | |
|---|---|---|---|---|
| 7,959,332 | B2 | 6/2011 | Tickner et al. | |
| 7,993,034 | B2 | 8/2011 | Wegner | |
| 2004/0108102 | A1* | 6/2004 | Otsuki et al. | 165/121 |
| 2005/0174780 | A1* | 8/2005 | Park | 362/294 |
| 2007/0236935 | A1 | 10/2007 | Wang | |
| 2007/0253202 | A1* | 11/2007 | Wu et al. | 362/294 |
| 2008/0007954 | A1* | 1/2008 | Li | 362/294 |
| 2009/0129102 | A1 | 5/2009 | Xiao et al. | |
| 2009/0135613 | A1* | 5/2009 | Peng | 362/373 |
| 2009/0141500 | A1 | 6/2009 | Peng | |
| 2009/0147520 | A1 | 6/2009 | Liu et al. | |
| 2009/0296402 | A1* | 12/2009 | Chang et al. | 362/294 |
| 2011/0254425 | A1 | 10/2011 | Huang et al. | |

FOREIGN PATENT DOCUMENTS

| | | |
|---|---|---|
| CN | 101338887 | 1/2009 |
| CN | 101566285 | 10/2009 |
| CN | 201416782 | 3/2010 |
| JP | 3135391 | 2/2001 |
| JP | 3148247 | 3/2001 |
| JP | 2007-193960 | 8/2007 |
| JP | 3135391 | 8/2007 |
| JP | 3148247 | 1/2009 |
| JP | 2009-163955 | 7/2009 |
| JP | 2010086713 | 4/2010 |
| TW | M278059 | 10/2005 |
| TW | M330426 | 4/2008 |
| TW | M344428 | 11/2008 |
| TW | M353309 | 3/2009 |
| TW | 200933079 | 8/2009 |
| TW | M364818 | 9/2009 |
| TW | M366884 | 10/2009 |
| TW | M368757 | 11/2009 |

OTHER PUBLICATIONS

Japan Patent Office, Office Action, Patent Application Serial No. 2010-211677, Jul. 3, 2012, Japan.

Japan Patent Office, Office Action, Patent Application Serial No. 2010-211678, Jul. 3, 2012, Japan.

China Patent Office, Office Action, Patent Application Serial No. 201010178032.2, Sep. 26, 2012, China.

China Patent Office, Office Action, Patent Application Serial No. 201010178033.7, Sep. 24, 2012, China.

Taiwan Patent Office, Office Action, Patent Application Serial No. 099112126, Jan. 14, 2013, Taiwan.

* cited by examiner

LAMP ASSEMBLY

CROSS REFERENCE TO RELATED APPLICATIONS

This Application claims priority of Taiwan Patent Application No. 099112126, filed on Apr. 19, 2010, the entirety of which is incorporated by reference herein.

BACKGROUND OF THE INVENTION

1. Field of the Invention

This application relates in general to a lamp assembly and in particular to an LED lamp assembly.

2. Description of the Related Art

As LEDs have low power dissipation and long endurance, they have been widely applied in various lamp apparatuses. Conventional LED lamps may comprise several metal fins for heat dissipation, so as to prevent failure due to overheating.

The metal fins are usually formed by die extrusion or die casting processes. However, the die extrusion process is expensive and forming complex structures therewith is difficult. As for the die casting process, manufacturing fin structures with fine pitches and durable strengths is difficult. Accordingly, it has been difficult to manufacture low cost lamp assemblies with fin structures having high cooling efficiency.

BRIEF SUMMARY OF INVENTION

The application provides a lamp assembly including a light source, a thermal module, a connecting member, and an adapter electrically connected to the light source. The thermal module includes a first thermal member and a second thermal member. The first and second thermal members respectively have a plurality of first and second fins which are arranged in a staggered manner. The second thermal member forms a plurality of through holes for heat dissipation. The light source is disposed on the second thermal member, and the connecting member connects the thermal module with the adapter.

BRIEF DESCRIPTION OF DRAWINGS

The invention can be more fully understood by reading the subsequent detailed description and examples with references made to the accompanying drawings, wherein.

DETAILED DESCRIPTION OF INVENTION

Figure 1:
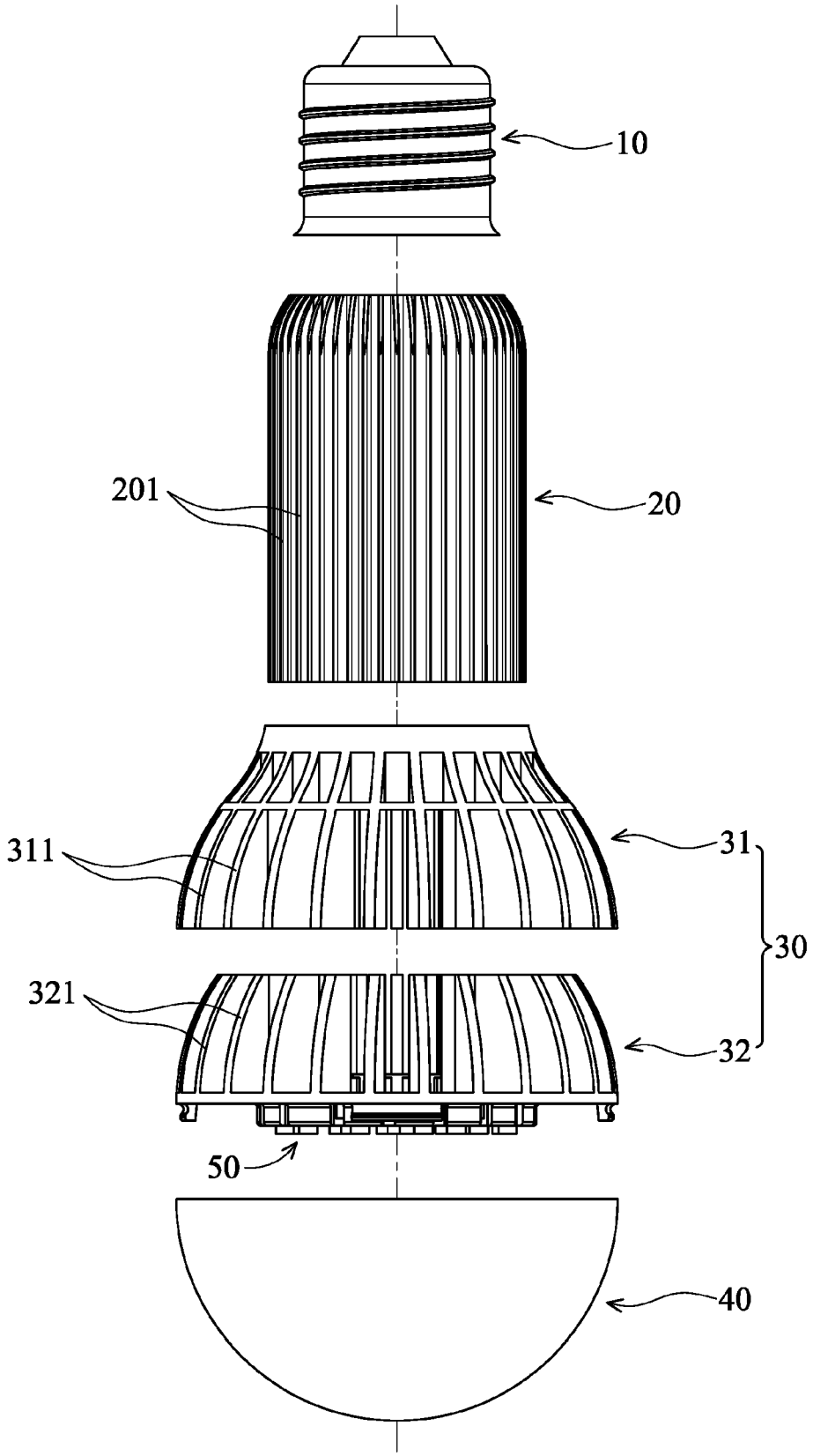
FIG. 1 is an exploded diagram of a lamp assembly according to an embodiment of the invention.
Figure 2:
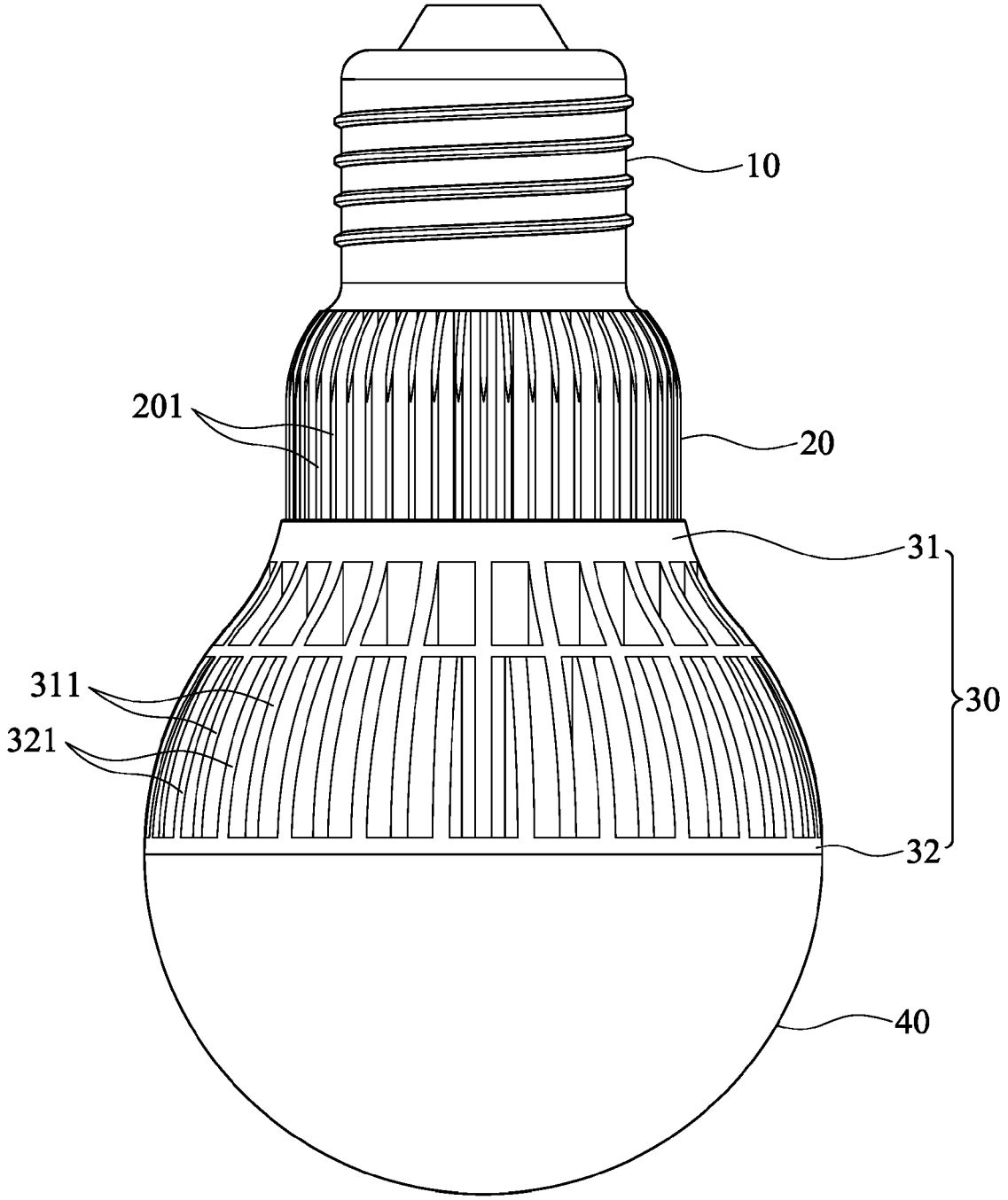
FIG. 2 is a perspective diagram of the lamp assembly in FIG. 1.

Referring to FIGS. 1 and 2, an embodiment of a lamp assembly primarily comprises an adapter 10, a connecting member 20, a thermal module 30, a shield 40, and at least a light source 50. In this embodiment, the light source 50 may be an LED, and the adapter 10 may be an E27 adapter electrically connected to the light source 50. Additionally, the connecting member 20 and the thermal module 30 may comprise aluminum or other materials with high thermal efficiency, wherein the thermal module 30 includes a first thermal member 31 and a second thermal member 32 which may be made by a die casting process, and the connecting member 20 may be made by a metal extrusion process.

As shown in FIGS. 1 and 2, the first thermal member 31 has a plurality of first fins 311, and the second thermal member 32 has a plurality of second fins 321. The first and second thermal members 31 and 32 may be respectively formed by a die casting process (such as an aluminum die casting process). During assembly, the first and second thermal members 31 and 32 are engaged with each other, wherein the first and second fins 311 and 321 are arranged in a staggered manner. In FIG. 1, the light source 50 is disposed on the bottom side of the second thermal member 32, wherein the shield 40 connects to the second thermal member 32 and encompasses the light source 50.

During the die casting process, since a fine pitch between adjacent fin structures is hard to achieve, the number of fin structures is adversely limited. To overcome the drawbacks of the die casting process, the present application provides a thermal module 30 including a first thermal member 31 and a second thermal member 32 engaged with each other, wherein the first and second fins 311 and 321 are arranged in a staggered manner to multiply the number of fins used; thus, increasing the surface area thereof and improving cooling efficiency.

Figure 3:
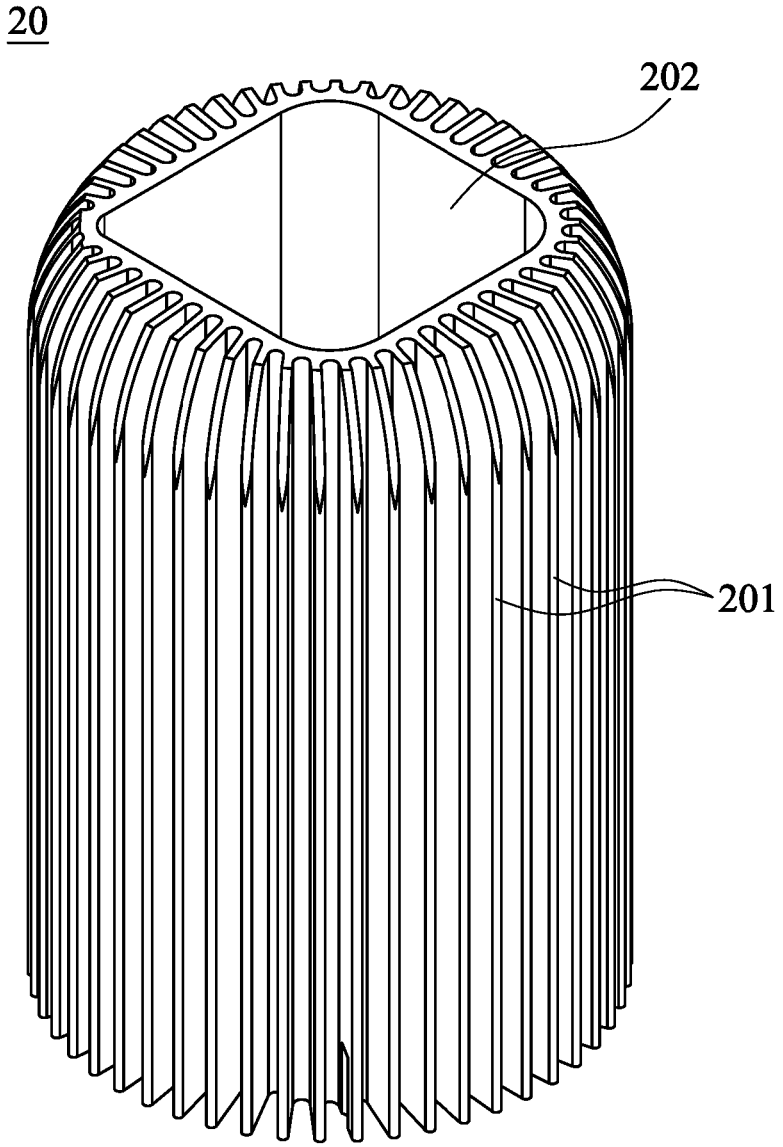
FIG. 3 is a perspective diagram of a connecting member according to an embodiment of the invention.

Referring to FIG. 3, an embodiment of the connecting member 20 may be formed by a metal extrusion process (such as an aluminum extrusion process). Circuit boards and other electrical components (not shown) can be disposed in a central hole 202 of the connecting member 20, to electrically connect the adaptor 10 with the light source 50. As shown in FIG. 3, the connecting member 20 has a plurality of thermal fins 201 around the central hole 202 to increase surface area thereof.

Figure 4:
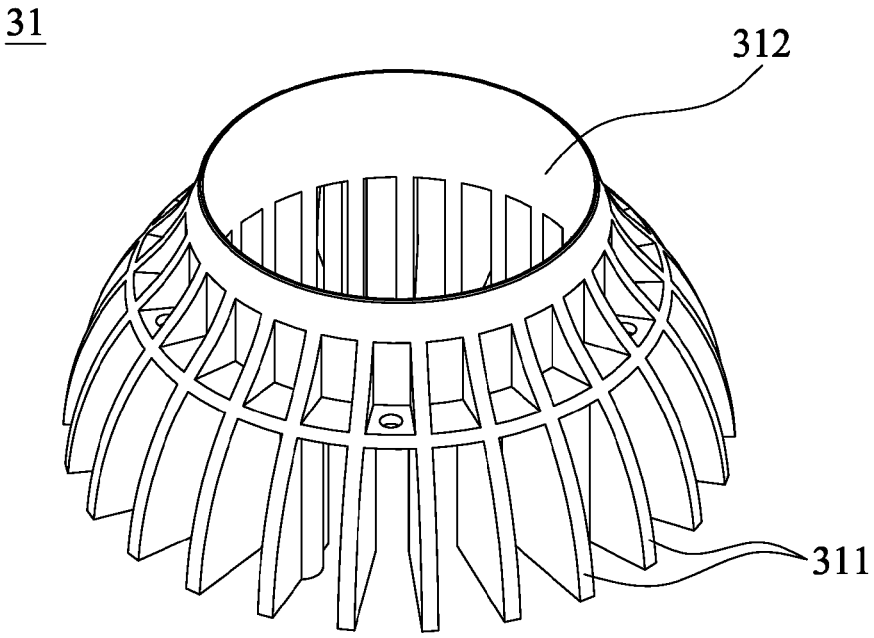
FIGS. 4 and 5 are perspective diagrams of a first thermal member according to an embodiment of the invention.
Figure 5:
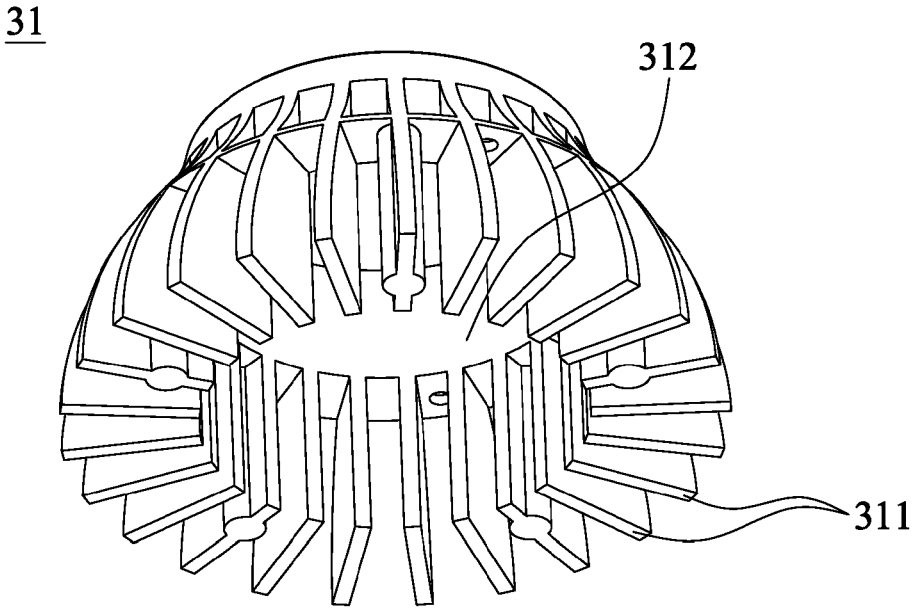
Figure 6:
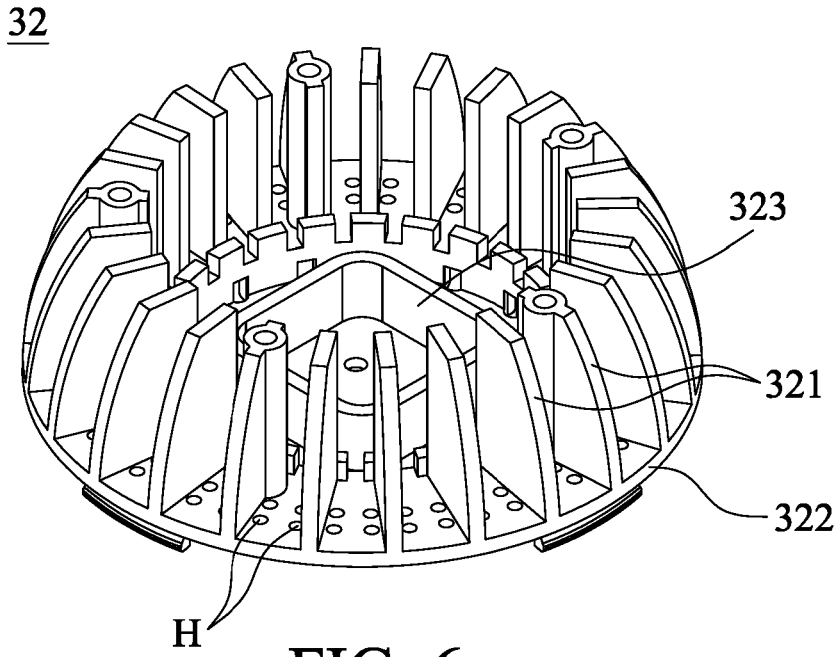
FIGS. 6 and 7 are perspective diagrams of a second thermal member according to an embodiment of the invention.

Referring to FIGS. 4 and 5, the first thermal member 31 has a round opening 312 size corresponding to the connecting member 20. The first thermal member 31 further has a plurality of first fins 311 radially formed around the round opening 312. Referring to FIG. 6, the second thermal member 32 comprises a base 322 and a plurality of second fins 321 radially disposed on the base 322, wherein the second fins 321 are substantially perpendicular to the base 322. When assembling the first and second thermal members 31 and 32, the first and second fins 311 and 321 are arranged in a staggered manner as shown in FIG. 2. The connecting member 20 is extended through the opening 312 of the first thermal member 31 and fixed to a connection portion 323 of the second thermal member 32.

Figure 7:
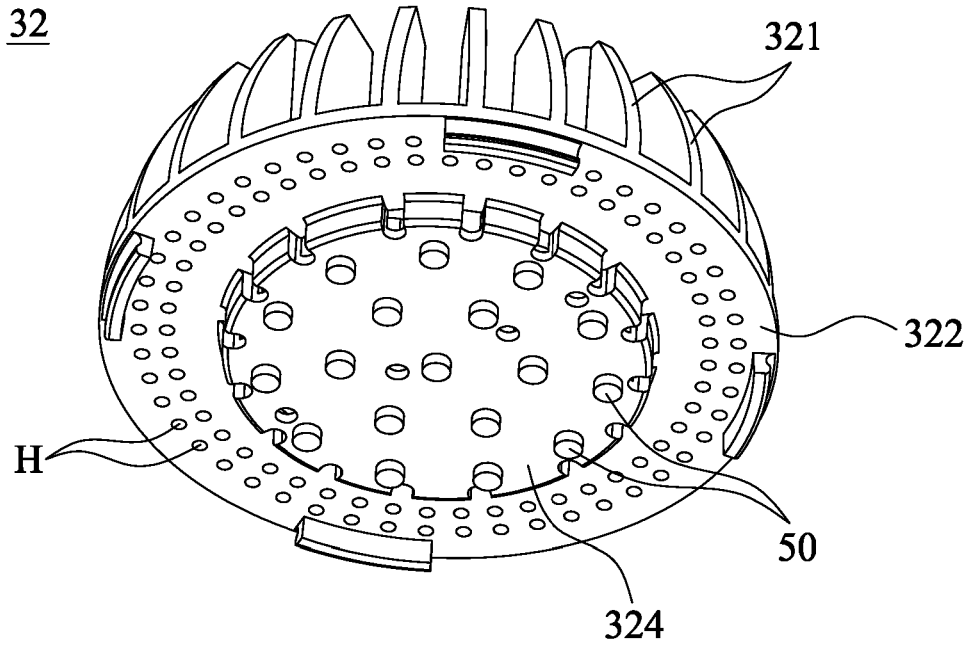
Figure 8:
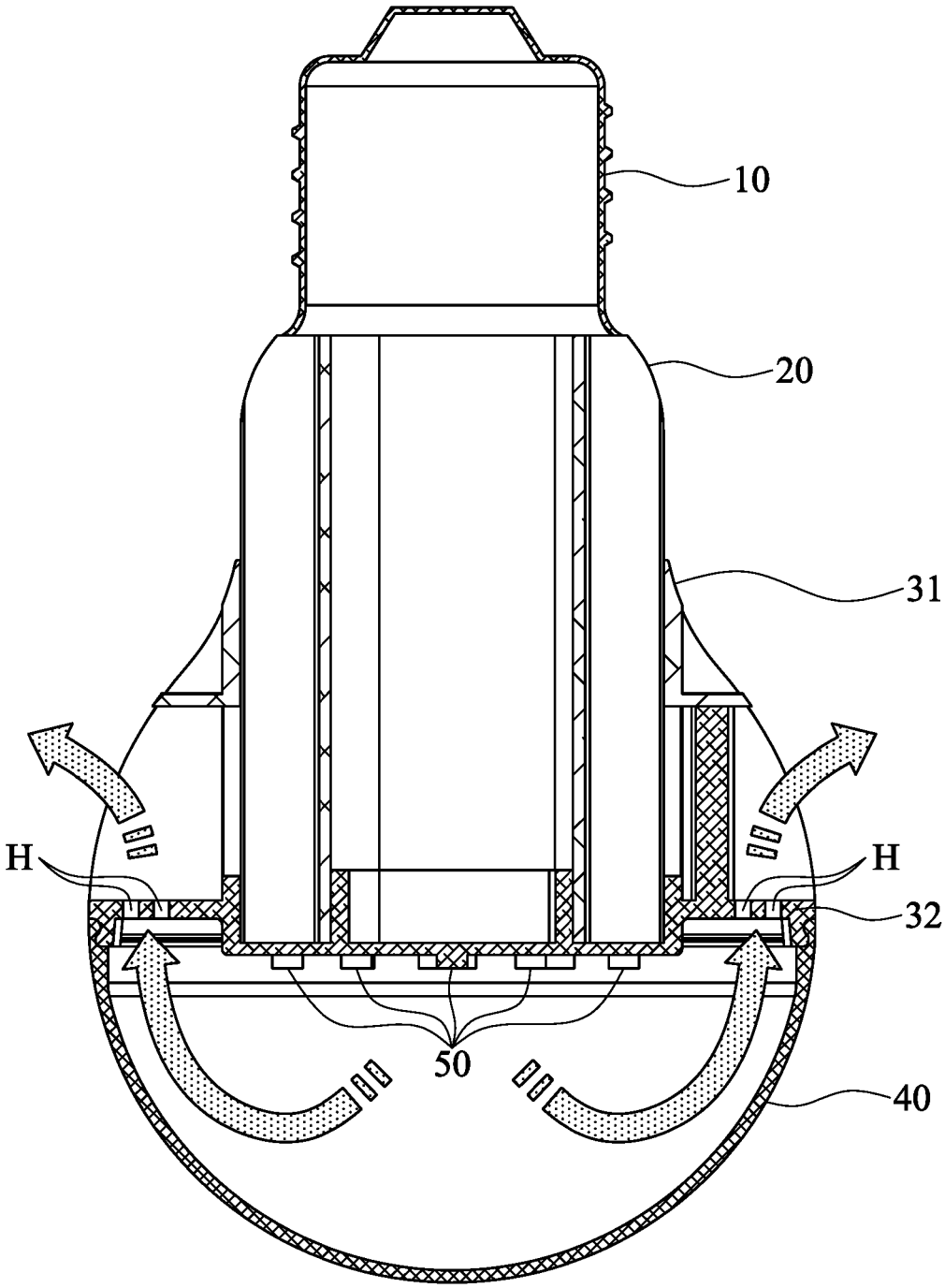
FIG. 8 is a sectional view of a lamp assembly according to an embodiment of the invention.

Referring to FIG. 7, the second thermal member 32 has a pedestal 324 with the light source 50 disposed thereon. The second fins 321 and the pedestal 324 are disposed on opposite sides of the base 322. In this embodiment, the base 322 comprises a plurality of through holes H distributed around the pedestal 324, so that heat generated from the light source 50 can be rapidly dissipated by air convection through the through holes H, and overheating and failure of the light source 50 may be prevented, as shown in FIG. 8.

The present application provides a lamp assembly including a thermal module, a light source disposed on the thermal module, an adapter, and a connecting member. The thermal module includes a first thermal member and a second thermal member respectively having a plurality of first and second fins which are arranged in a staggered manner to multiply the number of fins used; thus, increasing the surface area thereof and improving cooling efficiency. Specifically, the second thermal member forms a plurality of through holes to rapidly dissipate heat generated from the light source by air convection; thus, preventing overheating and failure of the light source.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation to encompass all such modifications and similar arrangements.

What is claimed is:

1. A lamp assembly, comprising:

a thermal module, comprising a first thermal member, comprising a plurality of first fins; and a second thermal member, comprising a base and a plurality of second fins extending upwardly from the base, wherein the first and second thermal members are arranged such that each first fin is interposed between walls of two adjacent second fins and seated contacting the base, and wherein the base comprises a plurality of through holes;

a light source, disposed on the second thermal member, wherein heat generated from the light source is dissipated by air convection through the through holes;

an adapter, electrically connected to the light source; and a connecting member, connecting the adapter with the thermal module.

2. The lamp assembly as claimed in claim 1, wherein the second fins are substantially perpendicular to the base.

3. The lamp assembly as claimed in claim 1, wherein the second thermal member further forms a pedestal with the light source disposed thereon, wherein the second fins and the pedestal are disposed on opposite sides of the base.

4. The lamp assembly as claimed in claim 1, wherein the connecting member extends through the first thermal member and connects to the second thermal member.

5. The lamp assembly as claimed in claim 1, wherein the first and second fins are radially arranged around the first and second thermal members.

6. The lamp assembly as claimed in claim 1, wherein the first and second thermal members are formed by a die casting process.

7. The lamp assembly as claimed in claim 1, wherein the connecting member is made by a metal extrusion process and forms a plurality of thermal fins.

8. The lamp assembly as claimed in claim 1, wherein the first and second thermal members are formed by an aluminum die casting process.

9. The lamp assembly as claimed in claim 1, wherein the connecting member is made by an aluminum extrusion process.

10. The lamp assembly as claimed in claim 1, wherein the lamp assembly further comprises a shield connecting to the second thermal member and encompassing the light source.

11. The lamp assembly as claimed in claim 1, wherein the base comprises a first planar surface, and the second fins are substantially perpendicular to the first planar surface.

12. The lamp assembly as claimed in claim 11, wherein the first thermal member comprises a second planar surface parallel to the first planar surface, and the plurality of first fins extend downwardly from the second planar surface.

13. The lamp assembly as claimed in claim 12, wherein each second fin contacts the second planar surface.

* * * * *